United States Patent [19]

Severson, Jr.

[11] Patent Number: 4,537,706

[45] Date of Patent: Aug. 27, 1985

[54] LIQUID DETERGENTS CONTAINING BORIC ACID TO STABILIZE ENZYMES

[75] Inventor: Roland G. Severson, Jr., Mason, Ohio

[73] Assignee: The Procter & Gamble Company, Cincinnati, Ohio

[21] Appl. No.: 609,944

[22] Filed: May 14, 1984

[51] Int. Cl.[3] ..... C11D 1/14; C11D 7/42

[52] U.S. Cl. ..... 252/545; 252/174.12; 252/174.19; 252/550; 252/546; 252/551; 252/553; 252/558; 252/DIG. 12; 252/DIG. 14

[58] Field of Search ..... 252/174.12, 174.19, 252/551, DIG. 14, DIG. 12, 545, 550, 546, 558, 553

[56] References Cited

U.S. PATENT DOCUMENTS

| | | | |
|---|---|---|---|
| T875,020 | 6/1970 | Dulat et al. | 252/138 |
| 4,261,868 | 4/1981 | Hora et al. | 252/529 |
| 4,305,837 | 12/1981 | Kaminsky et al. | 252/174.12 |
| 4,318,818 | 3/1982 | Letton et al. | 252/174.12 |
| 4,404,115 | 9/1983 | Tai | 252/135 |
| 4,421,668 | 12/1984 | Cox et al. | 252/174.12 |
| 4,462,922 | 7/1984 | Boskamp | 252/174.12 |
| 4,465,619 | 8/1984 | Boskamp | 252/540 |
| 4,490,285 | 12/1984 | Kebanli | 252/551 |

FOREIGN PATENT DOCUMENTS

| | | |
|---|---|---|
| 947213 | 5/1974 | Canada . |
| 1092036 | 12/1980 | Canada . |
| 80223 | 6/1983 | European Pat. Off. . |
| 126505 | 11/1984 | European Pat. Off. . |
| 3330323 | 3/1984 | Fed. Rep. of Germany . |
| 53-028515 | 8/1978 | Japan . |
| 2079305 | 1/1982 | United Kingdom . |
| 2126242 | 3/1984 | United Kingdom . |
| 2140818 | 12/1984 | United Kingdom . |
| 2140819 | 12/1984 | United Kingdom . |

*Primary Examiner*—Prince E. Willis

*Attorney, Agent, or Firm*—Donald E. Hasse; Robert B. Aylor; Thomas H. O'Flaherty

[57] ABSTRACT

Heavy-duty liquid detergents containing anionic surfactant, fatty acid, builder, proteolytic or amylolytic enzyme, boric acid or a boron compound capable of forming boric acid in the composition, and calcium ion are disclosed. Boric acid provides improved enzyme stability in the compositions.

13 Claims, No Drawings

LIQUID DETERGENTS CONTAINING BORIC ACID TO STABILIZE ENZYMES

TECHNICAL FIELD

The present invention relates to heavy-duty liquid detergents containing anionic synthetic surfactant, fatty acid, water-soluble detergency builder, proteolytic or amylolytic enzyme, boric acid or a boron compound capable of forming boric acid in the composition, and calcium ion. Boric acid has been found to provide improved enzyme stability in the built, anionic-based compositions herein.

The stabilization of enzymes is particularly difficult in built, heavy-duty liquid detergents containing high levels of anionic surfactants and water. Anionic surfactants, especially alkyl sulfates, tend to denature enzymes and render them inactive. Detergent builders can sequester the calcium ion needed for enzyme activity and/or stability.

While many different enzyme stabilizers have been proposed in the art, the combination of boric acid and calcium ion, preferably with a polyol, provides unexpectedly good stability in the present compositions.

BACKGROUND ART

U.S. Pat. No. 4,261,868, Hora et al, issued Apr. 14, 1981, discloses liquid detergents containing as an enzyme-stabilizing system, 2–25% of a polyfunctional amino compound selected from diethanolamine, triethanolamine, di-isopropanolamine, triisopropanolamine and tris(hydroxymethyl)aminomethane, and 0.25–15% of a boron compound selected from boric acid, boric oxide, borax, and sodium ortho-, meta- and pyroborate. The compositions can contain 10–60% surfactant, including anionics, and up to 40% builder.

U.S. Pat. No. 4,404,115, Tai, issued Sept. 13, 1983, discloses liquid cleaning compositions, preferably built liquid detergents, containing enzyme, 1–15% alkali metal pentaborate, 0–15% alkali metal sulfite, and 0–15% of a polyol having 2–6 hydroxy groups. The compositions can contain 1–60% surfactant, preferably a mixture of anionic and nonionic in a weight ratio of 6:1 to 1:1, with or without soap. The compositions also preferably contain 5–50% builder.

Japanese Patent Application No. J8028515, assigned to Nagase and Co., Ltd., published Aug. 15, 1978, discloses liquid detergents containing sorbitol and borax as an enzyme-stabilizing system.

Canadian Pat. No. 947,213, Dulat et al, issued May 14, 1974, discloses detergents containing enzymes and a mixed phosphate/borate builder system. (This same technology appears to be disclosed in U.S. Defensive Publication No. T875,020, published June 23, 1970.)

Canadian Pat. No. 1,092,036, Hora et al, issued Dec. 23, 1980, discloses enzymatic liquid detergents containing 4–25% polyol and boric acid (or boron-equivalent) in a weight ratio of polyol to boric acid less than 1. The compositions can contain 10–60% surfactant and up to 40% builder, although they are preferably unbuilt.

British Patent Application No. 2,079,305, Boskamp, published Jan. 20, 1982, discloses built liquid detergents containing enzyme, 4–25% polyol boric acid (or boron-equivalent), in a weight ratio of polyol to boric acid greater than 1, and 0.1–2% of a neutralized cross-linked polyacrylate. The compositions can contain 1–60% surfactant and up to 60% builder.

European Patent Application No. 80223, Boskamp, published June 1, 1983, discloses liquid detergents containing enzyme, 2–15% boric acid, 2–25% polyol or polyfunctional amino compound, and 5–20% of a sulfur-based reducing salt. The compositions can contain 1–60% surfactant and up to 60% builder.

German Patent Application No. 3,330,323, published Mar. 1, 1984, discloses in Examples 1 and 2 liquid detergents containing anionic surfactant, enzyme, calcium and 2% sodium borate.

U.S. Pat. No. 4,318,818, Letton et al, issued Mar. 9, 1982, discloses liquid detergents containing an enzyme-stabilizing system comprising calcium ion and a low molecular weight carboxylic acid or salt, preferably a formate.

SUMMARY OF THE INVENTION

This invention relates to heavy-duty liquid detergent compositions comprising, by weight:

(a) from about 10% to about 50% of an anionic synthetic surfactant;
(b) from about 3% to about 30% of a $C_{10}$–$C_{22}$ fatty acid;
(c) from about 2% to about 15% of a water-soluble detergency builder;
(d) from about 0.01% to about 5% of a proteolytic or amylolytic enzyme;
(e) from about 0.25% to about 10% of boric acid or a boron compound capable of forming boric acid in the composition;
(f) from about 1 to about 30 millimoles of calcium ion per liter of composition; and
(g) from about 20% to about 80% of water.

DETAILED DESCRIPTION OF THE INVENTION

The liquid detergents of the present invention contain, as essential components, anionic synthetic surfactant, fatty acid, water-soluble detergency builder, proteolytic or amylolytic enzyme, boric acid or a boron compound capable of forming boric acid in the composition, calcium ion, and water. Boric acid provides superior enzyme stability in the built, anionic-based liquid detergents herein. While not intending to be limited by theory, it is believed that boric acid and calcium form intramolecular bonds which effectively cross-link or staple an enzyme molecule together, thereby holding it in its active spatial conformation. Surprisingly, boric acid appears to be a better enzyme stabilizer in the present compositions than in compositions which are less stressful to enzymes, such as those containing less anionic surfactant and little or no builder.

ANIONIC SYNTHETIC SURFACTANT

The compositions of the present invention contain from about 10% to about 50%, preferably from about 12% to about 35%, and most preferably from about 15% to about 25%, by weight of an anionic synthetic surfactant. Suitable anionic surfactants are disclosed in U.S. Pat. No. 4,285,841, Barrat et al, issued Aug. 25, 1981, and in U.S. Pat. No. 3,929,678, Laughlin et al, issued Dec. 30, 1975, both incorporated herein by reference.

Useful anionic surfactants include the water-soluble salts, particularly the alkali metal, ammonium and alkylolammonium (e.g., monoethanolammonium or triethanolammonium) salts, of organic sulfuric reaction products having in their molecular structure an alkyl group containing from about 10 to about 20 carbon atoms and a sulfonic acid or sulfuric acid ester group. (Included in the term "alkyl" is the alkyl portion of aryl groups.) Examples of this group of synthetic surfactants are the alkyl sulfates, especially those obtained by sulfating the higher alcohols ($C_8$–$C_{18}$ carbon atoms) such as those produced by reducing the glycerides of tallow or coconut oil; and the alkylbenzene sulfonates in which the alkyl group contains from about 9 to about 15 carbon atoms, in straight chain or branched chain configuration, e.g., those of the type described in U.S. Pat. Nos. 2,220,099 and 2,477,383. Especially valuable are linear straight chain alkylbenzene sulfonates in which the average number of carbon atoms in the alkyl group is from about 11 to 14.

Other anionic surfactants herein are the water-soluble salts of: paraffin sulfonates containing from about 8 to about 24 (preferably about 12 to 18) carbon atoms; alkyl glyceryl ether sulfonates, especially those ethers of $C_{8-18}$ alcohols (e.g., those derived from tallow and coconut oil); alkyl phenol ethylene oxide ether sulfates containing from about 1 to about 4 units of ethylene oxide per molecule and from about 8 to about 12 carbon atoms in the alkyl group; and alkyl ethylene oxide ether sulfates containing about 1 to about 4 units of ethylene oxide per molecule and from about 10 to about 20 carbon atoms in the alkyl group.

Other useful anionic surfactants include the water-soluble salts of esters of alpha-sulfonated fatty acids containing from about 6 to 20 carbon atoms in the fatty acid group and from about 1 to 10 carbon atoms in the ester group; water-soluble salts of 2-acyloxy-alkane-1-sulfonic acids containing from about 2 to 9 carbon atoms in the acyl group and from about 9 to about 23 carbon atoms in the alkane moiety; water-soluble salts of olefin sulfonates containing from about 12 to 24 carbon atoms; and beta-alkyloxy alkane sulfonates containing from about 1 to 3 carbon atoms in the alkyl group and from about 8 to 20 carbon atoms in the alkane moiety.

Preferred anionic surfactants are the $C_{10}$–$C_{18}$ alkyl sulfates and alkyl ethoxy sulfates containing an average of up to about 4 ethylene oxide units per mole of alkyl sulfate, $C_{11}$–$C_{13}$ linear alkylbenzene sulfonates, and mixtures thereof.

The compositions preferably contain from about 1% to about 5%, more preferably from about 2% to about 4%, by weight of unethoxylated alkyl sulfate. These alkyl sulfates are desired for best detergency performance, but are very denaturing to enzymes. Boric acid is believed to be particularly effective at stabilizing enzymes in such stressful compositions.

The compositions herein can optionally contain other synthetic surfactants known in the art, such as the nonionic, cationic, zwitterionic, and ampholytic surfactants described in the above-cited Barrat et al and Laughlin et al patents.

A preferred cosurfactant, used at a level of from about 2% to about 25%, preferably from about 3% to about 15%, more preferably from about 4% to about 10%, by weight of the composition, is an ethoxylated nonionic surfactant of the formula $R^1(OC_2H_4)_nOH$, wherein $R^1$ is a $C_{10}$–$C_{16}$ alkyl group or a $C_8$–$C_{12}$ alkyl phenyl group, n is from about 3 to about 9, and said nonionic surfactant has an HLB (hydrophile-lipophile balance) of from about 10 to about 13. These surfactants are more fully described in U.S. Pat. Nos. 4,285,841, Barrat et al, issued Aug. 25, 1981, and 4,284,532, Leikhim et al, issued Aug. 18, 1981, both incorporated herein by reference. Particularly preferred are condensation products of $C_{12}$–$C_{15}$ alcohols with from about 3 to about 8 moles of ethylene oxide per mole of alcohol, e.g., $C_{12}$–$C_{13}$ alcohol condensed with about 6.5 moles of ethylene oxide per mole of alcohol.

Other preferred cosurfactants, used at a level of from about 0.5% to about 3%, preferably from about 0.7% to about 2%, by weight are certain quaternary ammonium, amine or amine oxide surfactants. The quaternary ammonium surfactants useful herein are of the formula:

$$[R^2(OR^3)_y][R^4(OR^3)_y]_2R^5N^+X^-$$

wherein $R^2$ is an alkyl or alkyl benzyl group having from about 6 to about 16 carbon atoms in the alkyl chain; each $R^3$ is selected from the group consisting of $-CH_2CH_2-$, $-CH_2CH(CH_3)-$, $-CH_2CH(CH_2OH)-$, $-CH_2CH_2CH_2-$, and mixtures thereof; each $R^4$ is selected from the group consisting of $C_1$–$C_4$ alkyl, $C_1$–$C_4$ hydroxyalkyl, benzyl, and hydrogen when y is not 0; $R^5$ is the same as $R^4$ or is an alkyl chain wherein the total number of carbon atoms of $R^2$ plus $R^5$ is from about 8 to about 16; each y is from 0 to about 10 and the sum of the y values is from 0 to about 15; and X is any compatible anion.

Preferred of the above are the alkyl quaternary ammonium surfactants, especially the mono-long chain alkyl surfactants described in the above formula when $R^5$ is selected from the same groups at $R^4$. The most preferred quaternary ammonium surfactants are the chloride, bromide and methylsulfate $C_{8-16}$ alkyl trimethylammonium salts, $C_{8-16}$ alkyl di(hydroxyethyl)-methylammonium salts, the $C_{8-16}$ alkyl hydroxyethyl-dimethylammonium salts, $C_{8-16}$ alkyloxypropyl trimethylammonium salts, and the $C_{8-16}$ alkyloxypropyl dihydroxyethylmethylammonium salts. Of the above, the $C_{10}$–$C_{14}$ alkyl trimethylammonium salts are preferred, e.g., decyl trimethylammonium methylsulfate, lauryl trimethylammonium chloride, myristyl trimethylammonium bromide and coconut trimethylammonium chloride and methylsulfate.

Under cold water washing conditions, i.e., less than about 65° F. (18.3° C.), the $C_{8-10}$ alkyl trimethylammonium surfactants are particularly preferred since they have lower Kraft boundaries and crystallization temperatures than the longer chain quaternary ammonium surfactants.

Amine surfactants useful herein are of the formula:

$$[R^2(OR^3)_y][R^4(OR^3)_y]R^5N$$

wherein the $R^2$, $R^3$, $R^4$, $R^5$ and y substituents are as defined above for the quaternary ammonium surfactants. Particularly preferred are the $C_{12-16}$ alkyl dimethyl amines.

Amine oxide surfactants useful herein are of the formula:

$$[R^2(OR^3)_y][R^4(OR^3)_y]R^5N\rightarrow 0$$

wherein the $R^2$, $R^3$, $R^4$, $R^5$ and y substituents are also as defined above for the quaternary ammonium surfactants. Particularly preferred are the $C_{12-16}$ alkyl dimethyl amine oxides.

Amine and amine oxide surfactants are preferably used at higher levels than the quaternary ammonium surfactants since they typically are only partially protonated in the present compositions. For example, preferred compositions herein can contain from about 0.5% to about 1.5% of the quaternary ammonium surfactant, or from about 1% to about 3% of the amine or amine oxide surfactants.

FATTY ACID

The compositions of the present invention also contain from about 3% to about 30%, more preferably from about 5% to about 20%, most preferably from about 8% to about 15%, by weight of a fatty acid containing from about 10 to about 22 carbon atoms. The fatty acid can also contain from about 1 to about 10 ethylene oxide units in the hydrocarbon chain. Preferred are saturated fatty acids containing from about 10 to about 14 carbon atoms. In addition, the weight ratio of $C_{10}$–$C_{12}$ fatty acid to $C_{14}$ fatty acid should be at least 1, preferably at least 1.5.

Suitable saturated fatty acids can be obtained from natural sources such as plant or animal esters (e.g., stripped palm kernel oil, stripped palm oil and coconut oil) or synthetically prepared (e.g., via the oxidation of petroleum or by hydrogenation of carbon monoxide via the Fisher-Tropsch process). Examples of suitable saturated fatty acids for use in the compositions of this invention include capric, lauric, myristic, coconut and palm kernel fatty acid. Preferred are saturated coconut fatty acids, from about 5:1 to 1:1 (preferably about 3:1) weight ratio mixtures of lauric and myristic acid, mixtures of the above with minor amounts (e.g., 10%–30% of total fatty acid) of oleic acid; and stripped palm kernel fatty acid.

WATER-SOLUBLE DETERGENCY BUILDER

The compositions herein contain from about 2% to about 15%, preferably from about 3% to about 10%, more preferably from about 4% to about 8%, by weight of a water-soluble detergent builder material. Detergent builders useful herein include the polycarboxylate, polyphosphonate and polyphosphate builders described in U.S. Pat. No. 4,284,532, Leikhim et al, issued Aug. 18, 1981, incorporated herein by reference. Polycarboxylate builders are preferred.

Suitable polycarboxylate builders include the various aminopolycarboxylates, cycloalkane polycarboxylates, ether polycarboxylates, alkyl polycarboxylates, epoxy polycarboxylates, tetrahydrofuran polycarboxylates, benzene polycarboxylates, and polyacetal polycarboxylates.

Examples of such polycarboxylate builders are sodium and potassium ethylenediaminetetraacetate; sodium and potassium nitrilotriacetate; the water-soluble salts of phytic acid, e.g., sodium and potassium phytates, disclosed in U.S. Pat. No. 1,739,942, Eckey, issued Mar. 27, 1956, incorporated herein by reference; the polycarboxylate materials described in U.S. Pat. No. 3,364,103, incorporated herein by reference; and the water-soluble salts of polycarboxylate polymers and copolymers described in U.S. Pat. No. 3,308,067, Diehl, issued Mar. 7, 1967, incorporated herein by reference.

Useful detergent builders also include the water-soluble salts of polymeric aliphatic polycarboxylic acids having the following structural and physical characteristics: (a) a minimum molecular weight of about 350 calculated as to the acid form; (b) an equivalent weight of about 50 to about 80 calculated as to acid form; (3) at least 45 mole percent of the monomeric species having at least two carboxyl radicals separated from each other by not more than two carbon atoms: (d) the site of attachment of the polymer chain of any carboxyl-containing radical being separated by not more than three carbon atoms along the polymer chain from the site of attachment of the next carboxyl-containing radical. Specific examples of such builders are the polymers and copolymers of itaconic acid, aconitic acid, maleic acid, mesaconic acid, fumaric acid, methylene malonic acid, and citraconic acid.

Other suitable polycarboxylate builders include the water-soluble salts, especially the sodium and potassium salts, of mellitic acid, citric acid, pyromellitic acid, benzene pentacarboxylic acid, oxydiacetic acid, carboxymethyloxysuccinic acid, carboxymethyloxymalonic acid, cis-cyclohexanehexacarboxylic acid, cis-cyclopentanetetracarboxylic acid and oxydisuccinic acid.

Other polycarboxylates for use herein are the polyacetal carboxylates described in U.S. Pat. No. 4,144,226, issued Mar. 13, 1979 to Crutchfield et al, and U.S. Pat. No. 4,146,495, issued Mar. 27, 1979 to Crutchfield et al, both incorporated herein by reference.

Polyphosphonate builders useful herein are disclosed in U.S. Pat. No. 3,213,030, Diehl, issued Oct. 19, 1965, U.S. Pat. No. 3,433,021, Roy, issued Jan. 14, 1968, U.S. Pat. No. 3,292,121, Gedge, issued Jan. 9, 1969 and U.S. Pat. No. 2,599,807, Bersworth, issued June 10, 1952, all incorporated herein by reference. Preferred polyphosphonate builders are the sodium and potassium salts of ethylene diphosphonic acid, ethane 1-hydroxy-1,1-diphosphonic acid, and ethane-1,1,2-triphosphonic acid.

Preferred aminopolyphosphonate builders are the sodium and potassium salts of diethylenetriaminepentamethylenephosphonic acid, hexamethylenediaminetetramethylenephosphonic acid, diethylenediaminetetramethylenephosphonic acid, and nitrilotrimethylenephosphonic acid.

Polyphosphates useful herein include the water-soluble tripolyphosphates, pyrophosphates, and the polymeric metaphosphates having a degree of polymerization of from about 6 to 21. However, the tripolyphosphates and metaphosphates tend to hydrolyze to a mixture of orthophosphate and pyrophosphate with prolonged storage in aqueous solutions. Since the orthophosphates precipitate but do not sequester water-hardness ions, the pyrophosphates are the preferred polyphosphates for use in the present invention. Particularly preferred is potassium pyrophosphate since sodium pyrophosphate has a tendency to precipitate from concentrated solutions at low storage temperatures.

Citrates are highly preferred builder materials. The compositions also preferably contain from about 0.1% to about 1%, preferably from about 0.2% to about 0.6%, by weight of water-soluble salts of ethylenediamine tetramethylene phosphonic acid, diethylenetriamine pentamethylenephosphonic acid, ethylenediamine tetraacetic acid, or diethylenetriamine pentaacetic acid to enhance cleaning performance when pretreating fabrics.

ENZYME

The compositions of the present invention contain from about 0.01% to about 5%, preferably from about 0.05% to about 2%, by weight of the composition of a proteolytic or amylolytic enzyme. Proteolytic enzymes are preferably included in an amount sufficient to provide an activity of from about 0.005 to about 0.1, more preferably from about 0.01 to about 0.07, most preferably from about 0.012 to about 0.04, Anson units per gram of composition.

Suitable proteolytic enzymes include the many species known to be adapted for use in detergent compositions. Commercial enzyme preparations such as "Alcalase" sold by Novo Industries, and "MAxatase" sold by Gist-Brocades, Delft, The Netherlands, are suitable. Other preferred enzyme compositions include those commercially available under the tradenames SP-72 ("Esperase") manufactured and sold by Novo Industries, A/S, Copenhagen, Denmark and "AZ-Protease" manufactured and sold by Gist-Brocades, Delft, The Netherlands.

The proteases herein are preferably purified prior to incorporation in the finished composition, so that they have no detectable odor at a concentration of less than about 0.002 Anson units per gram in one liter of distilled water. They preferably have no detectable odor at a concentration of less than about 0.0025, more preferably less than about 0.003, Anson units per gram per liter of distilled water.

Proteases herein can be odor purified by any method known in the art. Examples include the solvent precipitation methods described in *Precipitation of the Enzymes and Their Stability in High Alcohol Concentrations* by Bauer et al in the Israel J. Chem. 5(3), pages 117–20 (1967) and *Enzyme Preparations* by Sugiura et al and Yakusaigaku 1967, Volume 27(2), pages 135–9.

Solvent initiated precipitation of a crude commercial enzyme solution results in most of the enzymatic activity being precipitated from solution and most of the odor and color impurities remaining in the supernatant liquid. Decantation or centrifugation of the supernatant liquid from the precipitated enzyme results in an enzyme fraction with enriched enzymatic activity/gram and improved odor and color.

Various solvents or solvent pair combinations can be used to effect the desired precipitation. For example, methanol, ethanol, acetone, other organic solvents, and combinations of organic solvents with and without water can be used. A highly preferred solvent is a combination of water and 30–70% by weight ethanol. This appears to be optimal to prevent enzyme deactivation and maximum recovery of activity.

Purification of protease enzymes also provide benefits in the area of product color stability.

Amylases useful herein include "Rapidase" sold by Gist-Brocades and "Termamyl" sold by Novo Industries. Purifying amylases, using methods described above for purifying proteases, can also provide some finished product odor and/or color benefits. However, amylases are inherently less odorous and are typically used at much lower levels than the proteases, so malodors are generally not as severe.

A more complete disclosure of suitable enzymes can be found in U.S. Pat. No. 4,101,457, Place et al, issued July 18, 1978, incorporated herein by reference.

BORIC ACID

The compositions herein contain from about 0.25% to about 10%, preferably from about 0.5% to about 5%, more preferably from about 0.75% to about 3%, by weight of boric acid or a compound capable of forming boric acid in the composition (calculated on the basis of the boric acid). Boric acid is preferred, although other compounds such as boric oxide, borax and other alkali metal borates (e.g., sodium ortho-, meta- and pyroborate, and sodium pentaborate) are suitable. Substituted boric acids (e.g., phenylboronic acid, butane boronic acid, and p-bromo phenylboronic acid) can also be used in place of boric acid.

CALCIUM ION

The composition also contains from about 1 to about 30, preferably from about 2 to about 20, more preferably from about 5 to about 15, and most preferably from about 8 to about 12 millimoles of calcium ion per liter. The level of calcium ion should be selected so that there is always some minimum level available for the enzyme, after allowing for complexation with builders, fatty acid, etc., in the composition. Any water-soluble calcium salt can be used as the source of calcium ion, including calcium chloride, calcium formate, and calcium acetate. A small amount of calcium ion, generally from about 0.05 to about 0.4 millimoles per liter, is often also present in the composition due to calcium in the enzyme slurry and formula water.

WATER

Finally, the compositions herein contain from about 20% to about 80%, preferably from about 30% to about 60%, more preferably from about 35% to about 50%, by weight of water.

OPTIONAL COMPONENTS

The compositions of the present invention can also contain other materials known in the art to enhance enzyme stability. Particularly preferred are polyols containing only carbon, hydrogen and oxygen atoms. They preferably contain from 2 to 6 carbon atoms and from 2 to 6 hydroxy groups. Examples include propylene glycol (especially 1,2 propane diol, which is preferred), ethylene glycol, glycerol, sorbitol, mannitol, and glucose. The polyol generally represents from about 1% to about 15%, preferably from about 1.5% to about 10% most preferably from about 2% to about 7%, by weight of the composition. Preferably, the weight ratio of polyol to boric acid is at least 1, more preferably at least about 1.3.

The compositions can also contain the water-soluble, short chain carboxylates described in U.S. Pat. No. 4,318,818, Letton et al, issued Mar. 9, 1982, incorporated herein by reference. The formates are preferred and can be used at levels of from about 0.05% to about 5%, preferably from about 0.2% to about 2%, most preferably from about 0.4% to about 1.5%, by weight of the composition. Formates have been found to further enhance protease stability, although amylase stability appears to be slightly less than that obtained using boric acid alone.

The compositions herein have an initial pH of from about 6.5 to about 10, preferably from about 7 to about 9, most preferably from about 7.5 to about 8.8, at a concentration of 10% by weight in water at 68° F. (20° C.). Preferred pH buffers include monoethanolamine and triethanolamine. Monoethanolamine and triethanolamine also further enhance enzyme stability, and preferably are included at levels of from about 0.5% to about 10%, preferably from about 1% to about 4%, by weight of the composition.

Other optional components for use in the liquid detergents herein include soil removal agents, antiredeposition agents, suds regulants, hydrotropes, opacifiers, antioxidants, bactericides, dyes, perfumes, and brighteners known in the art. Such optional components generally represent less than about 15%, preferably from about 1% to about 10%, by weight of the composition.

The following examples illustrate the compositions of the present invention.

All parts, percentages and ratios used herein are by weight unless otherwise specified.

EXAMPLE I

The following compositions were prepared.

| Component | Wt. % | | | | |
|---|---|---|---|---|---|
| | A | B | C | D | E |
| $C_{13}$ linear alkylbenzene sulfonic acid | 7.2 | 7.2 | 7.2 | 7.2 | 7.2 |
| $C_{14-15}$ alkyl polyethoxylate (2.25) sulfuric acid | 10.8 | 10.8 | 10.8 | 10.8 | 10.8 |
| ($C_{14-15}$ alkyl sulfuric acid) | (2.5) | (2.5) | (2.5) | (2.5) | (2.5) |
| $C_{12-13}$ alcohol polyethoxylate (6.5)* | 6.5 | 5.0 | 5.0 | 5.0 | 6.5 |
| $C_{12}$ alkyl trimethylammonium chloride | 1.2 | 0.6 | 0.6 | — | 0.6 |
| $C_{12-14}$ alkyl dimethyl amine oxide | — | — | — | 2.5 | — |
| $C_{12-14}$ fatty acid | 13.0 | 10.0 | 10.0 | 13.9 | 13.0 |
| Oleic acid | 2.0 | — | — | 1.5 | 2.0 |
| Citric acid (anhydrous) | 4.0 | 4.0 | 4.0 | 4.0 | 4.0 |
| Sodium diethylenetriamine pentaacetate | 0.3 | 0.3 | 0.3 | — | 0.6 |
| Sodium ethylenediamine tetraacetate | — | — | — | 0.5 | — |
| Protease enzyme (2.0 AU/g) | 0.75 | 0.75 | 0.75 | — | — |
| Protease enzyme (1.5 AU/g) | — | — | — | 1.0 | 1.0 |
| Amylase enzyme (325 Am. U/g) | 0.16 | 0.16 | 0.16 | — | — |
| Amylase enzyme (162 Am. U/g) | — | — | — | 0.37 | 0.37 |
| TEPA-$E_{15-18}$** | 1.5 | 1.5 | 1.5 | 1.5 | 1.5 |
| Monoethanolamine | 2.0 | — | 1.0 | — | 2.3 |
| Triethanolamine | — | 2.0 | — | 4.0 | 4.0 |
| Sodium hydroxide | 1.36 | 4.0 | 4.0 | — | — |
| Potassium hydroxide | 8.64 | 2.2 | 2.2 | — | — |
| Sodium/potassium hydroxide | — | — | — | 2–4 | 3.4 |
| 1,2 Propane diol | 6.25 | 2.5 | 2.5 | 8.0 | 4.0 |
| Ethanol | 7.75 | 7.0 | 8.0 | 5.5 | 6.5 |
| Boric acid | As indicated | | | | |
| Sodium formate | As indicated | | | | |
| Calcium ion*** (mm/l) | 9.65 | 9.65 | 9.65 | 13.5 | 15.6 |
| Minors and water | Balance to 100 | | | | |

*Alcohol and monoethoxylated alcohol removed.

**Tetraethylene pentaimine ethoxylated with 15–18 moles (avg.) of ethylene oxide at each hydrogen site.

***Includes estimated 0.25 millimoles of calcium ion per liter from enzyme slurry and formula water.

Enzyme stability in Composition A, as measured by protease half-life at 100° F. (37.8° C.), was as follows.

| | A1 | A2 | A3 |
|---|---|---|---|
| % Boric acid | — | 1.0 | 1.0 |
| % Sodium formate | 1.0 | — | 1.0 |
| Half-life (weeks) | 0.81 | 6.7 | 9.8 |

Enzyme stability in Composition A, as measured by protease and amylase half-lives at 90° F. (32.2° C.), was as follows.

| | A4 | A5 | A6 | A7 | A8 | A9 | A10 | A11 |
|---|---|---|---|---|---|---|---|---|
| % Boric acid | 1.0 | 1.0 | 1.0 | 0.5 | 0.5 | — | — | — |
| % Sodium formate | — | 0.5 | 1.0 | 0.5 | 1.0 | 1.0 | 1.5 | 2.0 |
| Protease half-life (weeks)* | 17.3 | 38.2 | 66.4 | 19.7 | 12.4 | 9.5 | 9.7 | 9.1 |
| Amylase half-life (weeks) | 15.3 | 14.1 | 13.3 | 10.8 | 9.3 | 5.5 | 5.2 | 5.8 |

*Half-lives should only be compared to others within this test.

Enzyme stability in Composition B, as measured by protease and amylase half-lives at 100° F. (37.8° C.), was as follows.

| | B1 | B2 | B3 | B4 |
|---|---|---|---|---|
| % Boric acid | — | — | 1.0 | 1.0 |
| % Sodium formate | — | 1.0 | — | 1.0 |
| Protease half-life (weeks) | 0.5 | 1.4 | 3.6 | 6.5 |
| Amylase half-life (weeks) | 3.5 | 4.7 | 17.1 | 17.1 |

Enzyme stability in Composition C, as measured by protease and amylase half-lives at 100° F. (37.8° C.), was as follows.

| | C1 | C2 | C3 | C4 |
|---|---|---|---|---|
| % Boric acid | — | 1.5 | 1.5 | 1.5 |
| % Sodium formate | 1.0 | 1.0 | — | 0.12 |
| Protease half-life (weeks) | 1.0 | 12.4 | 6.4 | 5.4 |
| Amylase half-life (weeks) | 2.0 | 7.5 | 8.6 | 4.3 |

Enzyme stability in Compositions D and E, as measured by protease and amylase half-lives at 100° F. (37.8° C.), was as follows. (NC means no significant change in stability after six weeks.)

| | D1 | D2 | D3 | D4 | D5 | D6 | E1 | E2 | E3 | E4 | E5 | E6 | E7 | E8 | E9 | E10 |
|---|---|---|---|---|---|---|---|---|---|---|---|---|---|---|---|---|
| % Boric acid | — | 0.5 | 1.0 | 1.0 | 1.5 | 2.0 | — | 0.5 | 1.0 | 1.0 | 1.5 | 2.0 | 0 | 0 | 1 | 2 |
| % Sodium formate | 1.0 | 0.66 | 0.33 | 1.0 | — | — | 1.0 | 0.66 | 0.33 | 1.0 | — | — | 0 | 1 | 0 | 0 |
| Protease half-life (weeks) | 5.6 | 8.7 | 11.8 | 14.5 | 16.7 | 17.0 | 8.9 | 11.1 | 14.6 | 17.2 | 33.4 | 21.7 | 3.7 | 8.2 | 19.2 | NC |
| Amylase half-life (weeks) | 40.5 | 63.2 | NC | NC | NC | NC | 15.8 | 21.0 | 37.6 | NC | 38.6 | NC | 12.6 | 18.1 | NC | NC |

The above results demonstrates that boric acid is a much better enzyme stabilizer than sodium formate in Compositions A–E of the invention. In addition, the combination of boric acid and formate provides even greater protease stability, but slightly less amylase stability, than that obtained using boric acid alone.

The use of boric acid to stabilize enzymes in Compositions A–E in place of sodium formate also allows for a reduction in the level of sodium and calcium ions, which enhances the stability of the compositions against precipitation when stored at low temperatures or under freeze-thaw conditions.

EXAMPLE II

The following compositions were prepared.

| Component | Wt. % | |
|---|---|---|
| | A | B |
| Sodium $C_{12-14}$ alcohol polyethoxylate (3) sulfate | 11.6 | — |
| $C_{12-13}$ alcohol polyethxylate (6.5) | 21.5 | — |
| $C_{14-15}$ alcohol polyethoxylate (7)* | — | 18.0 |

-continued

| Component | Wt. % A | Wt. % B |
|---|---|---|
| $C_{12-14}$ alkyldimethyl amine oxide | — | 1.0 |
| Ditallow dimethylammonium chloride | — | 3.0 |
| TEPA-$E_{15-18}$** | — | 1.5 |
| Ethanol | 10.0 | 7.5 |
| Protease enzyme (2.0 AU/g) | 1.3 | 0.75 |
| Amylase enzyme (375 Am. U/g) | — | 0.17 |
| Boric acid | As indicated | |
| Sodium formate | As indicated | |
| Calcium ion*** (mm/l) | 0.25 | 2.5 |
| Minors and water | Balance to 100 | |

*Alcohol and monoethoxylated alcohol removed.
**Tetraethylene pentaimine ethoxylated with 15–18 moles (avg.) of ethylene oxide at each hydrogen site.
***Includes estimated 0.25 millimoles of calcium ion per liter from enzyme slurry and formula water.

Enzyme stability in Compositions A and B, as measured by half-lives at 100° F. (37.8° C.), was as follows.

| | A1 | A2 | A3 | A4 | A5 | A6 | B1 | B2 |
|---|---|---|---|---|---|---|---|---|
| % Boric acid | — | — | — | 1.0 | 1.0 | 1.0 | — | 1.0 |
| % Sodium formate | — | 0.5 | 1.0 | — | 0.5 | 1.0 | 1.2 | — |
| Protease half-life (weeks) | 3.0 | 7.4 | 7.4 | 2.6 | 2.7 | 3.0 | 5.8 | 3.6 |
| Amylase half-life (weeks) | | | | | | | 10.3 | 8.8 |

These results demonstrate that sodium formate is a better enzyme stabilizer in Compositions A and B (not compositions within the scope of the invention) than is boric acid. Furthermore, the addition of 1% boric acid to Compositions A1, A2 and A3 (as in A4, A5, and A6) reduces protease stability to less than or equal to that obtained without formate in control Composition A1.

What is claimed is:

1. A heavy-duty liquid detergent composition comprising, by weight:

(a) from about 10% to about 50% of an anionic synthetic surfactant;

(b) from about 3% to about 30% of a $C_{10}$–$C_{22}$ fatty acid;

(c) from about 2% to about 15% of a water-soluble detergency builder;

(d) from about 0.01% to about 5% of a proteolytic or amylolytic enzyme;

(e) from about 0.25% to about 10% of boric acid or a boron compound capable of forming boric acid in the composition;

(f) from about 1 to about 30 millimoles of calcium ion per liter of composition; and (g) from about 20% to about 80% of water.

2. A composition according to claim 1 comprising from about 15% to about 25% of the anionic synthetic surfactant.

3. A composition according to claim 2 comprising from about 1% to about 5% of an unethoxylated $C_{10}$–$C_{18}$ alkyl sulfate.

4. A composition according to claim 2 comprising from about 8% to about 15% of a saturated fatty acid containing from about 10 to about 14 carbon atoms.

5. A composition according to claim 1 comprising from about 3% to about 10% of builder, which is a polycarboxylate.

6. A composition according to claim 5 wherein the polycarboxylate builder comprises citrate.

7. A composition according to claim 6 comprising from about 0.1% to about 1% of a water-soluble salt of ethylenediamine tetramethylenephosphonic acid, diethylenetriamine pentamethylenephosphonic acid, ethylenediamine tetraacetic acid, or diethylenetriamine pentaacetic acid.

8. A composition according to claim 7 comprising from about 0.75% to about 3% of boric acid.

9. A composition according to claim 8 comprising from about 5 to about 15 millimoles of calcium ion per liter of composition.

10. A composition according to claim 9 comprising from about 15% to about 25% anionic surfactant, which is a mixture comprising $C_{10}$–$C_{18}$ alkyl sulfate, $C_{10}$–$C_{18}$ alkyl ethoxy sulfate containing an average of up to about 4 moles of ethylene oxide per mole of alkyl sulfate, and $C_{11}$–$C_{13}$ linear alkylbenzene sulfonate, with about 1% to about 5% being an unethoxylated $C_{10}$–$C_{18}$ alkyl sulfate.

11. A composition according to claim 10 comprising from about 8% to about 15% of a saturated fatty acid containing from about 10 to about 14 carbon atoms.

12. A composition according to claim 1 further comprising from about 1% to about 15% of a polyol containing from 2 to 6 carbon atoms and from 2 to 6 hydroxy groups.

13. A composition according to claim 11 further comprising from about 2% to about 7% of 1,2 propane diol.

* * * * *